US006027360A

United States Patent [19]

Jenkins

[11] Patent Number: 6,027,360

[45] Date of Patent: Feb. 22, 2000

[54] JUNCTION BLOCK BRACKET FOR FLOATING CONNECTOR ATTACHMENT

[75] Inventor: Roderick Rhys Jenkins, Canton, Mich.

[73] Assignee: Yazaki Corporation, Tokyo, Japan

[21] Appl. No.: 09/095,691

[22] Filed: Jun. 10, 1998

[51] Int. Cl.[7] ..... H01R 13/627

[52] U.S. Cl. ..... 439/364; 439/248

[58] Field of Search ..... 439/248, 364, 439/378, 701, 247

[56] References Cited

U.S. PATENT DOCUMENTS

| | | | |
|---|---|---|---|
| 4,923,411 | 5/1990 | Hayashi et al. . | |
| 4,954,085 | 9/1990 | Inoue et al. . | |
| 5,201,625 | 4/1993 | Takenouchi et al. . | |
| 5,217,386 | 6/1993 | Ohsumi et al. . | |
| 5,431,573 | 7/1995 | Endo et al. . | |
| 5,480,322 | 1/1996 | Ishii et al. | 439/378 |
| 5,651,683 | 7/1997 | Shimamura et al. | 439/248 |

*Primary Examiner*—Michael L. Gellner
*Assistant Examiner*—Antoine Ngandjui
*Attorney, Agent, or Firm*—Young & Basile, P.C.

[57] ABSTRACT

An apparatus for securing wire harness terminal connectors to the underside of an electrical junction block in a blind assembly operation. The apparatus includes a flotation bracket with chambers for receiving the connectors in a mechanical snap-fit in which the connectors are free to float up and down over a limited range within their respective chambers. The connector-containing bracket is next placed in a lower cover, which then fits over the underside of the junction block. Bolts rotatably mounted in the junction block are located to automatically engage captive nuts held in the connectors. As the bolts are subsequently threaded through the captive nuts, the connectors are drawn up in the bracket chambers from a lower rest position to an upper electrical engagement position where the terminals in the connector are placed in electrical engagement with bus bars in the junction block. Upper stops in the chambers prevent the connectors from moving beyond the electrical engagement position and damaging parts of the junction block, bus bars, connectors and terminals.

6 Claims, 4 Drawing Sheets

JUNCTION BLOCK BRACKET FOR FLOATING CONNECTOR ATTACHMENT

FIELD OF THE INVENTION

This invention relates in general to wire harness terminal connectors which mate with junction blocks, and more specifically to devices for holding the connectors while the connectors are electrically connected to components on the block.

DISCUSSION OF RELATED ART

Junction blocks are typically used in automotive vehicles to streamline electrical wiring by eliminating multi-branch wiring. A junction block enables branch circuits, fuses, relays and other electrical circuit components to be consolidated in a single housing. The housing is often located within a vehicle engine compartment. Electrical connectors attached to the housing connect the circuit components through wire harnesses to various electrical devices, such as headlamps, fuel pumps, windshield wiper motors and ignition switches.

As vehicle electrical systems become more complex, the number of circuits packaged in the typical junction block has increased. However, space constraints in the engine compartment preclude expanding the size of the junction block. As a result, it is increasingly necessary to mount additional electrical connectors on less-accessible portions of the junction block, for example underneath. The junction block then has to be awkwardly inverted to properly join the connectors and their wire harnesses to its lower side, and may even have to be removed from the engine compartment.

U.S. Pat. No. 5,431,573 discloses a connector assembly frame used to connect an array of male terminals to female terminals fixed in a base board. The male terminals are first loosely mounted in the frame with laterally projecting mounting pins engaging elongated cam-type slots in the frame sidewall. One end of the frame is then pivotally mounted on the baseboard, and the male terminals are sequentially cammed into electrical engagement with the female terminals by rotating the frame down onto the base board.

U.S. Pat. No. 5,431,573 also discloses a "prior art" connector assembly in its FIGS. 25 and 26, wherein a group of male connector terminals are simultaneously driven into a female connector bracket with a bolt-driven "holding member". The bolt passes through the holding member and the male connector group into a threaded hole in the female connector bracket. As the bolt is threaded into the female connector bracket, the holding member simultaneously pushes each connector in the male connector group into a corresponding receptacle of the female connector bracket.

U.S. Pat. No. 5,480,322 illustrates another bolt-tightened connector assembly, in which the male connectors are locked into a first frame against up or down movement, and the female connectors are secured in a second frame. A bolt on the male connector frame engages a nut trapped in the female connector frame to pull them together, guided by ribs on the male connector frame.

SUMMARY OF THE INVENTION

The present invention is a bracket adapted to hold at least one, and preferably several, electrical connectors in position for a "blind", throughbolt-type engagement with terminals in a junction block. In general the bracket comprises at least one (and preferably multiple) connector-holding chambers having open tops and bottoms for receiving an electrical connector through the open bottom, the chamber including lower stop structure which allows the comnector to be inserted into the chamber and then floated in position for engagement by a throughbolt from the junction block. The chamber further includes upper stop structure adapted to prevent the connector from being raised within the chamber past an electrical terminal engagement position. The electrical connector is free to float between the lower and upper stop structure within the chamber but normally rests on the lower stop structure until it is drawn up by the throughbolt to the terminal engagement position.

In a further form of the invention, the bracket is complemented by a lower cover which secures the connector-containing bracket to the junction block.

This invention, together with other objects, features, aspects and advantages thereof, will be more clearly understood from the following description, considered in conjunction with the accompanying drawings.

COMPLETE DESCRIPTION OF THE PREFERRED EMBODIMENT

Figure 1:
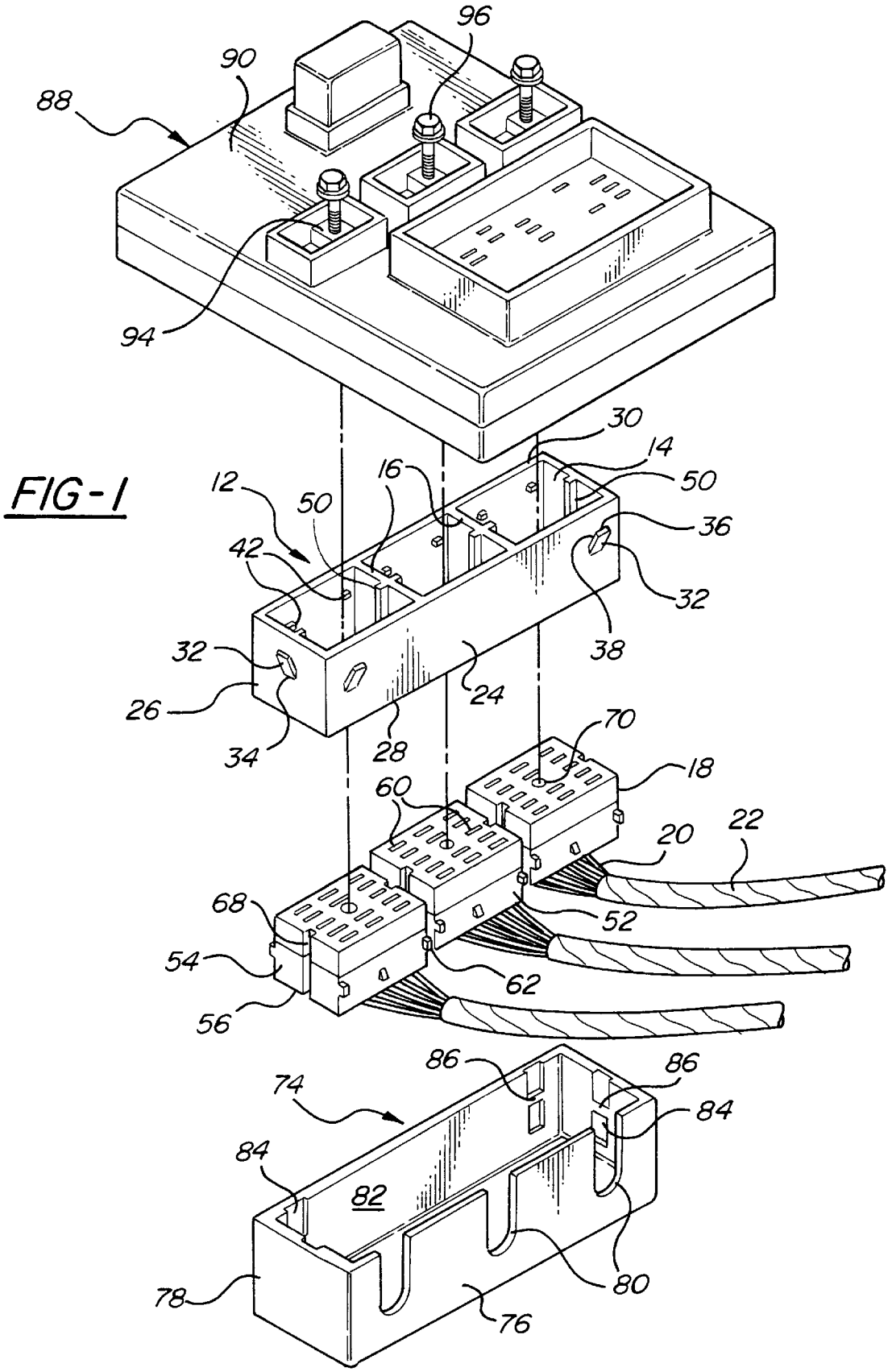
FIG. 1 is an exploded perspective view of a bracket according to the present invention, in combination with a junction block, modified lower cover, and modified wire harness connectors.
Figure 2:
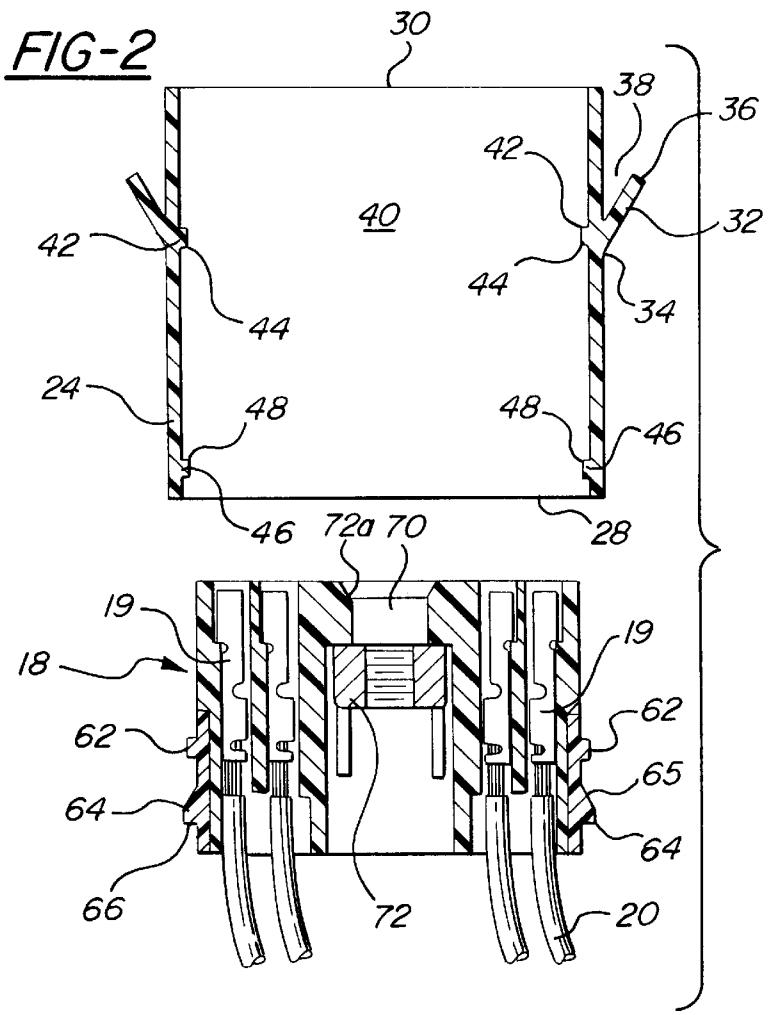
FIG. 2 is a cross-sectional side view of the bracket and a connector prior to mounting the connector in the bracket.

Referring now to FIGS. 1 and 2, an illustrated example of a flotation bracket 12 according to the present invention is divided into three male connector chambers 14. The ends of electrical wires 20 from harnesses 22 are terminated in male connectors 18 by electrical terminals 19 (FIG. 2) received and held in the connectors in a conventional manner.

Illustrated flotation bracket 12 is generally rectangular, with two long side walls 24 and two shorter end walls 26. The bracket has a bottom edge 28 and a top edge 30, but is otherwise open on top and bottom. Each end wall 26 has an exterior spring tab 32, and each side wall 24 includes a pair of tabs 32. The tabs have free ends 36 spaced from the end and side walls by gaps 38. The spring tabs 32 are adapted to releasably lock with mating structure in a separate lower cover 74, in a manner described below.

Flotation bracket 12 has three chambers 14. Referring to FIG. 2, each chamber includes pairs of upper stops 42 with shoulders 44 facing the bottom of the flotation bracket. Lower stops 46 are located centrally near the bottom of the bracket, with shoulders 48 facing the top of the bracket. The stops are preferably integrally molded in the bracket. Chambers 14 also include vertical guide ribs 50 running top to bottom on the transverse inner faces of each chamber (FIGS. 1 and 4).

Figure 4:
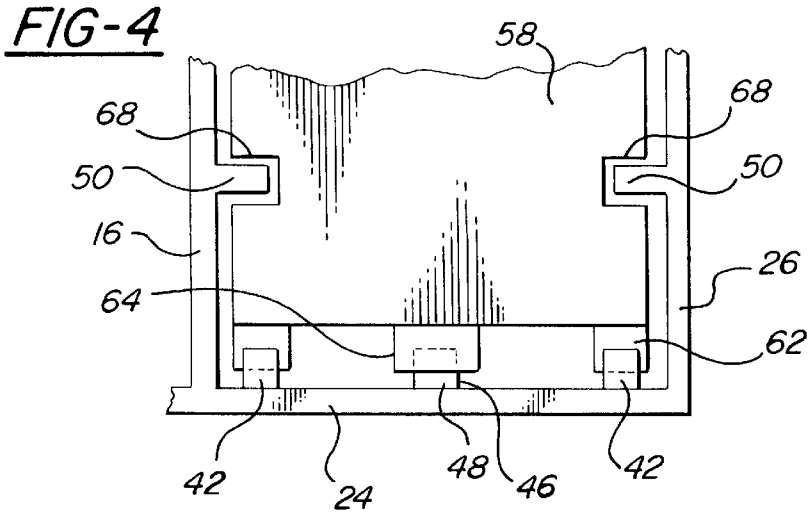
FIG. 4 is a partial top view of the bracket-mounted connector of FIG. 3.

Referring now to FIGS. 1, 2, and 4, each connector 18 has two longer side walls 52 corresponding to the side walls 24 of bracket 12, and two shorter end walls 54. Electrical terminals 19 are received in terminal chambers opening on the underside 56 of the connector. Upper side 58 is provided with a matching set of terminal chambers 60 for receiving mating terminals or bus bars from a female connector. Each side wall 52 has two small upper stops 62 located at approximately mid-height on the connector. A lower stop 64 is located centrally near the bottom of each side wall 52, with an inclined upper face 65 and a bottom shoulder 66. The end walls 54 of the connectors include vertical grooves 68 sized and positioned to receive the guide ribs 50 in bracket chambers 14 when the connectors are inserted into the bracket, as best shown in FIG. 4. Once male connectors 18 are seated in chambers 14, flotation bracket 12 is designed to be received in lower cover 74 (FIG. 1) for a junction block. Lower cover 74 is basically a box with an open top, sized to receive the flotation bracket. In the illustrated embodiment, cover 74 has two long sides 76 extending between ends 78. One of the sides 76 has spaced, upwardly-opening slots 80 for wire harnesses 22. Channels 84 are formed on the inner surfaces 82 of the cover, with one channel on each end wall 78 and two channels on each side wall 76. Each channel 84 is designed to receive one of tabs 32 on bracket 12 in a sliding snap-fit over beveled lock ramps 86.

Figure 5:
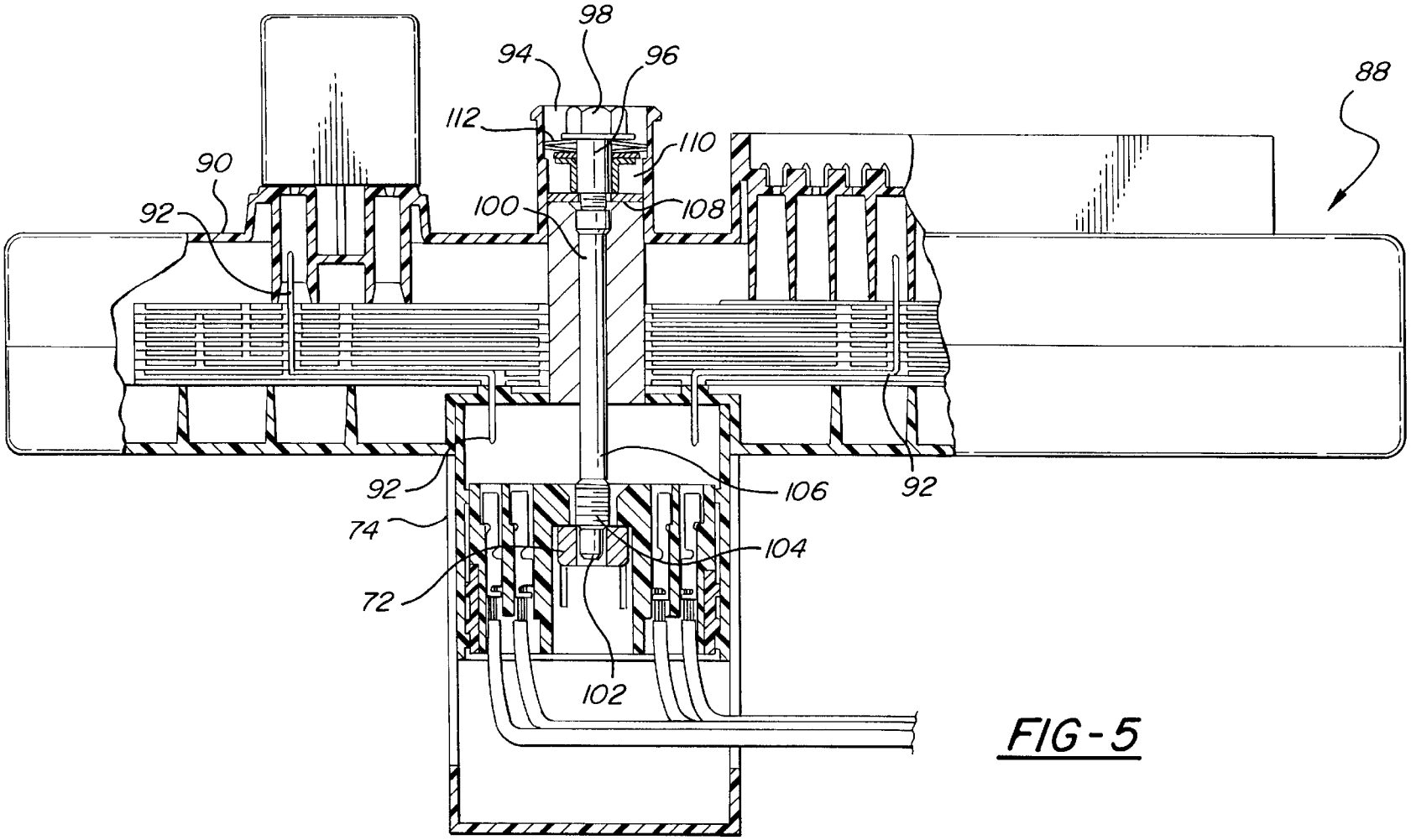
FIG. 5 is a cross-sectional side view of the structure shown in FIG. 1, with the bracket secured to the junction block prior to electrical engagement of the connector with the junction block.
Figure 6:
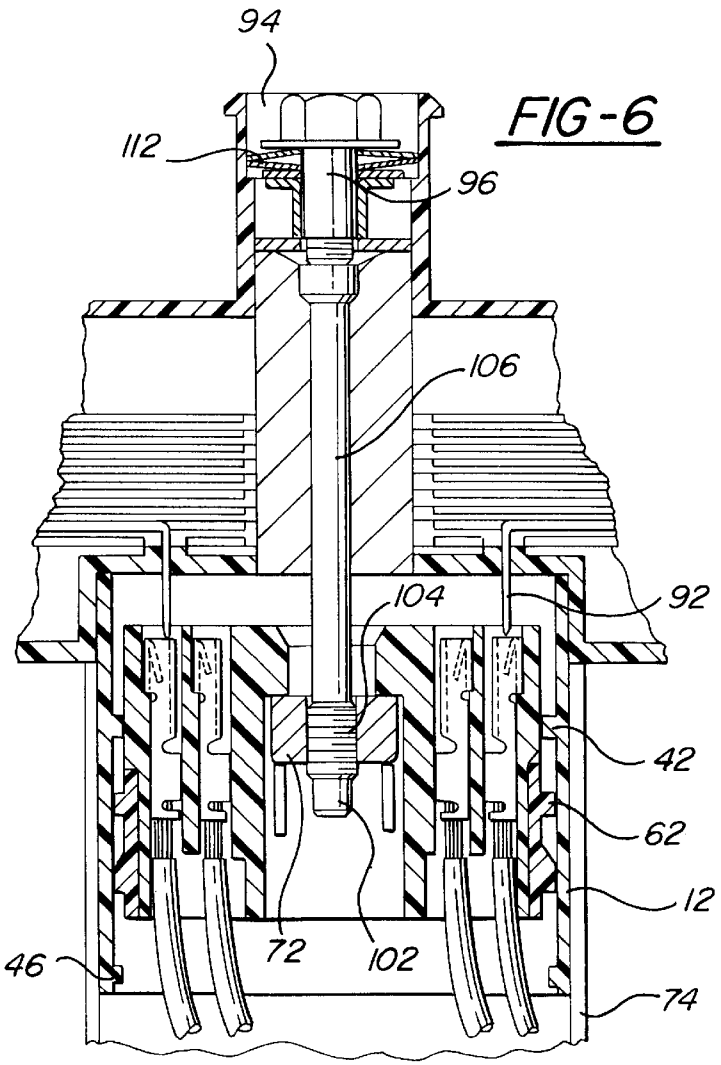
FIG. 6 is a detailed view of the connector and bracket of FIG. 5, illustrating the initial bolt-driven engagement of the connector to the junction block as the connector "floats" inside the bracket.

Still referring to FIG. 1, a junction block 88 comprises an upper mounting surface 90 for receiving electrical components such as connectors, relays and fuses. Cavities through the mounting surface enable blades or terminals from the components to electrically mate with internal junction block bus bars 92, as illustrated in FIGS. 5 and 6. The junction block further includes bolt apertures 94 extending through the block, one for each chamber 14. Bolts 96 are rotatably secured in apertures 94, and are of a conventional type for securing connectors together such that their electrical terminals mate, while over-tightening of the bolt, which could damage the terminals, is prevented. The bolt has a head 98 and a shank 100. The shank has an insertion end 102 with a short, threaded section 104. A longer, non-threaded section 106 extends between the threaded section 104 and an integral flange 108. An insert collar 110 secured in the aperture 94 between the flange 108 and bolt head 98 secures the bolt in position with the aperture while allowing it to rotate freely. A spring device 112 is preferably sandwiched between the bolt head and insert member. The bolt and aperture structure may be as illustrated or may take other known forms, for example as disclosed in U.S. Pat. No. 5,201,625, which is hereby incorporated by reference.

Figure 3:
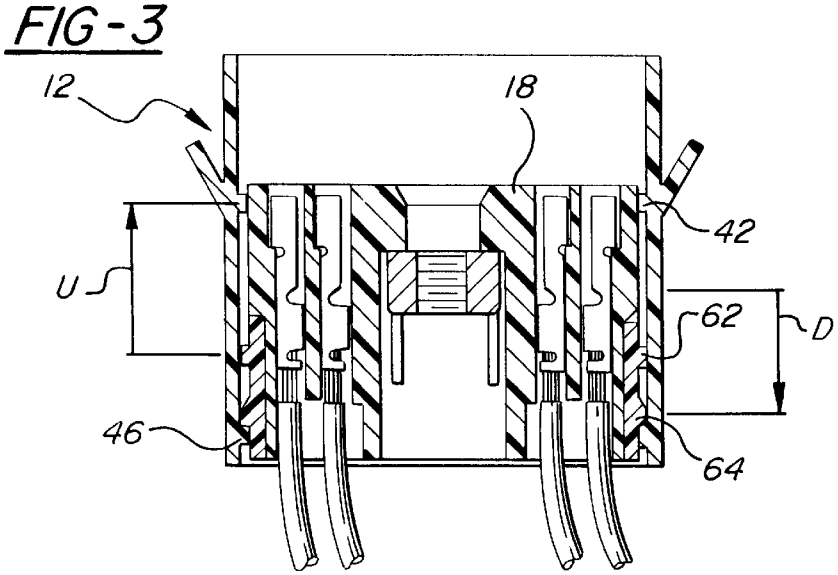
FIG. 3 is the same cross-sectional view as in FIG. 2, but illustrating the connector mounted in the bracket.

In operation, wire harness connectors 18 are inserted into bracket chambers 14 from the bottom of flotation bracket 12 (FIGS. 2 and 3). Guide ribs 50 in the chambers slide into grooves 68 in the connectors, as best shown in FIG. 4. Guide ribs 50 align the connector in the chamber and guide connector ramps 64 into contact with lower stops 46 on the inner walls of the chamber. As the connector is pushed into the bracket chamber, each ramp 64 slides over associated lower stop 46 until it snaps past the stop and shoulder 66 of the ramp rests on shoulder 48 of stop 46. Stops 46 prevent the connector from falling out of the bottom of the flotation bracket once inserted as described above. At the same time, the pairs of upper stops 42 near the top of the bracket prevent the connector from being pushed or pulled out through the top of the bracket by virtue of their engagement with connector stops 62.

As best shown in FIG. 3, connectors 18 in their respective chambers 14 and flotation bracket 12 are free to "float" up and down between upper stops 42 and lower stops 46, limited in downward movement by ramps 64 and in upward movement by mid-level connector stops 62. This range of motion is illustrated by the arrows "U" and "D" in FIG. 3.

Referring again to FIG. 1, the connector-containing bracket is next inserted into the open top of lower cover 74. Wire harnesses 22 are received in U-shaped openings 80, while spring tabs 32 enter channels 84, the free ends 36 of the spring tabs snapping into place over lock ramps 86 to secure the bracket in the lower cover. The length of channels 84 is designed to provide room between the underside of the connector and the bottom of the lower cover to accommodate any bend in the wire harnesses. The wire harnesses, connectors, bracket and lower cover can be transported in this pre-assembled condition for fitting to the junction block at a final assembly point.

FIG. 5 illustrates lower cover 74 fitted to the underside of the junction block 88. Conventional latch devices (not shown) on the block and cover secure the block and cover together. Bolts 96 now engage captive nuts 72 in connectors 18, initially being threaded partway into the nuts. Each connector is therefore held in a first or to disengaged position by its respective partway-threaded bolt (FIG. 5), with the stop surfaces 66 of connector ramps 64 resting on shoulders 48 of stops 46 on the bracket's inner walls. At the position shown in FIG. 5, there is no electrical contact between the bus bars 92 of the junction block 88 and connector terminals 19. Additionally, the junction block, lower cover, bracket and connectors are stationary with respect to one another, i.e. the bracket and lower cover remain fixed in position and the connectors cannot move in the bracket except when their respective bolts are threaded further into the connectors through captive nuts 72.

It will be apparent to those skilled in the art that the chamfered opening 72*a* in the connector above captive nut 72 is sized and positioned to guide the end 102 of bolt 96 into the nut threads even though the person assembling the connector-containing bracket to the junction block is working "blind", because the bolt cannot actually be seen engaging the connector. The pre-assembly of connectors 18 and flotation bracket 12 accordingly provides an important alignment function, automatically aligning each of the connectors 18 with its respective bolt 96 in junction block 88 for positive, repeatable blind assembly in which the ends of the bolts are automatically guided into the threads of captive nut 72. At this point the person assembling the unit can give each bolt head a few quick turns to thread the end of the bolt partway into its respective connector nut to achieve the initial assembly of FIG. 5.

Figure 7:
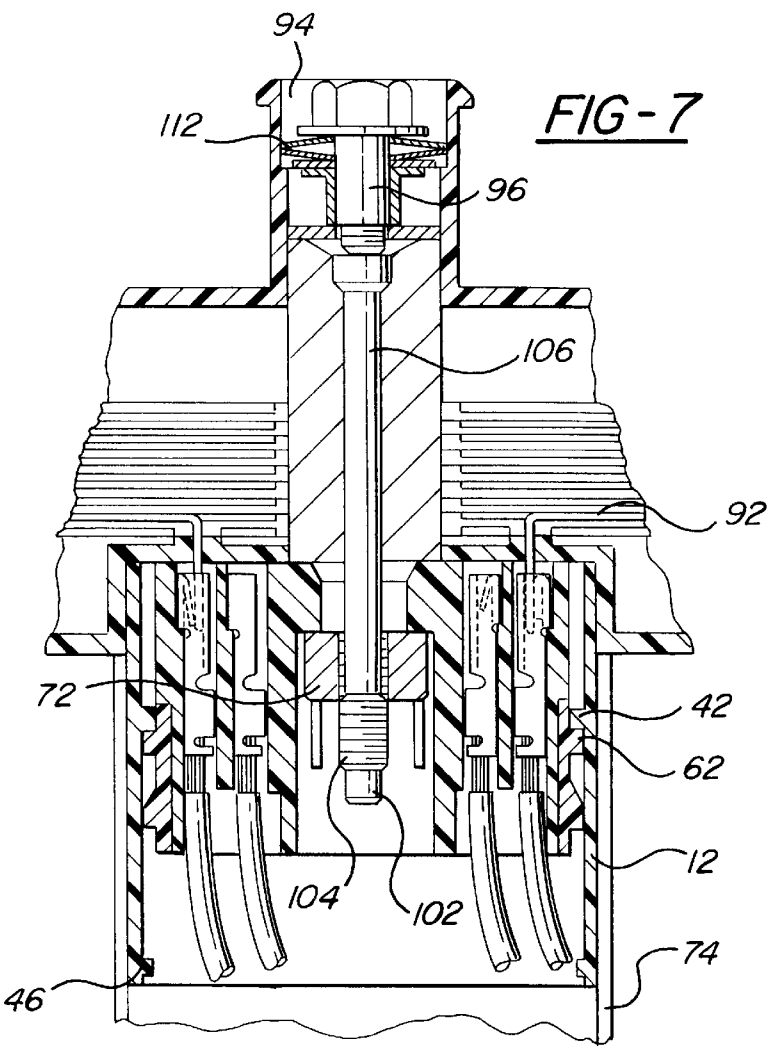
FIG. 7 shows the connector of FIG. 6 fully engaged with the junction block terminals inside the bracket.

In order to electrically engage the junction block bus bars and the connector terminals as desired, bolts 96 are subsequently threaded fully through captive nuts 72 in the connectors as shown in FIGS. 6 and 7. As the bolts are rotated, connectors 18 are drawn upward toward the junction block (FIG. 6) until their terminals 19 mate with junction block bus bars 92 (FIG. 7). When the connectors are in this second, electrically engaged position shown in FIG. 7, the mid-level stops 62 on the connectors meet upper stops 42 on the inner walls of the bracket, preventing further upward movement of the connector. Simultaneously, the threaded sections 104 of the bolts pass through captive nuts 72. If torque is applied the bolt will continue to spin, but since only the non-threaded section 106 of the bolt lies within the captive nut, the bolt cannot be tightened further and no damage will occur to the mated parts.

To disengage the connectors from the junction block, the bolt is simply rotated in the opposite direction. Spring device 112 sandwiched between bolt head 98 and insert member 110 keeps the threaded section 104 biased upwardly against the threads of the captive nut. Therefore, when the bolt is turned in the opposite direction, threads 104 and nut 72 engage and the connector is forced back down into the bracket to the electrically disengaged position of FIG. 5.

The invention illustrated by the embodiments above allows connectors to be relatively effortlessly mated with junction block components through the underside of the junction block. Connector installation and electrical engagement can be made as a "blind" operation. Serviceability of the junction block and connectors and even of the electrical systems supplied with power from the junction block is improved, since the electrical connections can be safely disengaged by simply loosening the bolts. The multiple-connector flotation bracket pre-aligns multiple connectors for simultaneous blind installation, reducing assembly time.

Since minor changes and modification varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements. Accordingly, I claim:

What is claimed is:

1. A bracket for supporting an electrical connector for electrical engagement with a junction block, the bracket comprising:

a chamber having an open top and bottom for receiving an electrical connector through the open bottom, the chamber including lower stop structure in the chamber adapted to allow the electrical connector to be inserted into the chamber through the open bottom and to prevent the electrical connector from falling back out of the open bottom once inserted, the chamber further including upper stop structure in the chamber adapted to prevent the connector from being raised within the chamber past an electrical terminal engagement position, the lower stop structure and the upper stop structure being spaced a distance apart such that the electrical connector is free to float between the lower and upper stop structure within the chamber but normally rests on the lower stop structure, the bracket being adapted to be attached to a lower surface of a junction block such that bolt means on the junction block extends into the chamber when the bracket is attached to the junction block to initially engage a captive nut in the connector when the connector is resting on the lower stop structure, whereby rotation of the bolt means from an upper surface of the junction block moves the electrical connector upwardly in the bracket chamber from the lower stop structure until it engages the upper stop structure, at which point the electrical connector is in electrical engagement with the junction block.

2. A bracket as defined in claim 1, further including a plurality of chambers adapted to floatingly support a plurality of electrical connectors for engagement by a plurality of bolts on the junction block.

3. A bracket as defined in claim 1, wherein the bracket includes a lower cover adapted to receive the connector-containing bracket and to attach the connector-containing bracket to the lower surface of the junction block.

4. A bracket as defined in claim 1 further comprising at least one vertical guide in the chamber separate from the lower and upper stop structure and adapted to slidingly engage a mating portion of the connector to guide the vertical movement of the connector within the chamber between the lower and upper stop structure.

5. An apparatus for mechanically and electrically connecting a wire harness terminal connector to the underside of a junction block, comprising:

a bracket with a top and an underside, the bracket having a connector-receiving chamber adapted to receive a connector through the underside of the bracket, the chamber including an array of movement-limiting stops adapted to permit entry of the connector into the chamber from the underside of the bracket to a flotation position in which the connector is trapped for limited up and down movement in the chamber between upper and lower sets of the stops, the bracket being adapted to be attached to the underside of a junction block at the top of the bracket while the connector rests on the lower set of stops, the lower set of stops holding the connector in an initial engagement position for blind engagement with a bolt on the junction block, and the upper set of stops defining a fill engagement position in which the electrical connector is fully electrically connected to the junction block when the bolt is operated to move the connector toward the top edge of the bracket, the upper stops preventing movement of the connector upwardly beyond the full engagement position.

6. An apparatus as defined in claim 5, wherein the bracket includes a plurality of connector-receiving chambers for receiving a plurality of connectors in the initial engagement position for blind engagement by a plurality of bolts on the junction block.

* * * * *